US006991035B2

(12) United States Patent
Hall et al.

(10) Patent No.: US 6,991,035 B2
(45) Date of Patent: Jan. 31, 2006

(54) DRILLING JAR FOR USE IN A DOWNHOLE NETWORK

(75) Inventors: David R. Hall, Provo, UT (US); Joe Fox, Spanish Fork, UT (US); James McPherson, Sandy, UT (US); David S. Pixton, Lehi, UT (US); Michael Briscoe, Lehi, UT (US)

(73) Assignee: IntelliServ, Inc., Provo, UT (US)

( * ) Notice: Subject to any disclaimer, the term of this patent is extended or adjusted under 35 U.S.C. 154(b) by 178 days.

(21) Appl. No.: 10/653,604

(22) Filed: Sep. 2, 2003

(65) Prior Publication Data

US 2005/0045339 A1 Mar. 3, 2005

(51) Int. Cl.
*E21B 31/107* (2006.01)

(52) U.S. Cl. ..... 166/301; 166/65.1; 166/178; 175/321

(58) Field of Classification Search ..... 175/321, 175/323; 166/65.1, 301, 380, 178, 242.7
See application file for complete search history.

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |
| 2,659,773 | A | 11/1953 | Barney |
| 2,662,123 | A | 12/1953 | Koenig, Jr. |
| 2,748,358 | A | 5/1956 | Johnston |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |
| 3,170,137 | A | 2/1965 | Brandt |
| 3,186,222 | A | 6/1965 | Martin |
| 3,194,886 | A | 7/1965 | Mason |
| 3,209,323 | A | 9/1965 | Grossman, Jr. |
| 3,227,973 | A | 1/1966 | Gray |
| 3,253,245 | A | 5/1966 | Brandt |
| 3,518,608 | A | 6/1970 | Papadopoulos |
| 3,696,332 | A | 10/1972 | Dickson, Jr. et al. |

(Continued)

FOREIGN PATENT DOCUMENTS

| | | | |
|---|---|---|---|
| EP | 0399987 | A1 | 11/1990 |

(Continued)

*Primary Examiner*—William Neuder
(74) *Attorney, Agent, or Firm*—Jeffery E. Daly; Tyson J. Wilde

(57) ABSTRACT

Apparatus and methods for integrating transmission cable into the body of selected downhole tools, such as drilling jars, having variable or changing lengths. A wired downhole-drilling tool is disclosed in one embodiment of the invention as including a housing and a mandrel insertable into the housing. A coiled cable is enclosed within the housing and has a first end connected to the housing and a second end connected to the mandrel. The coiled cable is configured to stretch and shorten in accordance with axial movement between the housing and the mandrel. A clamp is used to fix the coiled cable with respect to the housing, the mandrel, or both, to accommodate a change of tension in the coiled cable.

24 Claims, 12 Drawing Sheets

U.S. PATENT DOCUMENTS 3,793,632 A 2/1974 Still
3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 Macleod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,558,532 A * 9/1996 Hopper ..... 439/310
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,223,826 B1 5/2001 Chau et al.
6,367,565 B1 4/2002 Hall
6,392,317 B1 5/2002 Hall et al.
6,405,795 B2 6/2002 Holbert et al.
6,481,495 B1 * 11/2002 Evans ..... 166/65.1
6,641,434 B2 11/2003 Boyle et al.
6,655,464 B2 12/2003 Chau et al.
6,670,880 B1 12/2003 Hall et al.
2002/0135179 A1 9/2002 Boyle et al.
2002/0193004 A1 12/2002 Boyle et al.
2003/0070842 A1 4/2003 Bailey et al.
2003/0147360 A1 * 8/2003 Nero et al. ..... 370/314
2003/0213598 A1 11/2003 Hughes
2004/0150533 A1 * 8/2004 Hall et al. ..... 340/854.4

FOREIGN PATENT DOCUMENTS

WO W8801096 2/1988
WO WO9014497 11/1990

* cited by examiner

DRILLING JAR FOR USE IN A DOWNHOLE NETWORK

This invention was made with government support under Contract No. DE-FC26-01NT41229 awarded by the U.S. Department of Energy. The government has certain rights in the invention.

BACKGROUND OF THE INVENTION

1. Field of the Invention

This invention relates to oil and gas drilling, and more particularly to apparatus and methods for integrating network and other transmission media into downhole drilling tools.

2. Background

During downhole drilling operations, drilling jars are used to send shock waves up and down the drill string to dislodge or loosen stuck drill string components, such as a drill bit. Most drilling jars operate by storing potential energy generated from tension or compression in the drill string caused by straining or compressing the drill string uphole at the drill rig. The jar releases this potential energy by suddenly opening, thereby allowing energy stored as strain or compression in the drill string to be released, causing shock waves to travel in a desired direction along the drill string. These shock waves may be sufficient to dislodge a stuck downhole tool or tools.

Most downhole tools have several characteristics in common. For example, due to the shape and configuration of a drill string, many downhole tools, with the exception of the drill bit, have a "pin end" and "box end" to enable the tools to be connected in series along the length of the drill string. The pin end is characterized by external threads that may be threaded into corresponding internal threads of the box end. Because torque is applied to the drill string to rotate the drill bit, the box end and pin end are rotationally fixed with respect to one another. In most cases, the box end and pin end are also axially fixed with respect to one another, meaning that the length of the tool is fixed.

However, in certain types of downhole tools, such as in downhole jars, the length of the tool is variable. For example, a downhole drilling jar generates shock waves by allowing rapid axial movement between the box end and pin end. The axial movement is suddenly stopped when an internal "hammer" hits an internal "anvil", causing significant shock waves to propagate from the jar. In most jars, the total axial range of motion is limited to approximately 24 inches.

As drilling continues to advance, downhole tools that have axial movement between the pin end and box end may present certain challenges. For example, apparatus and methods are currently being developed to integrate network cable or other transmission media into downhole tools in order to transmit data from downhole tools and sensors to the surface for analysis. This may enable information to be transmitted at much higher speeds than is currently available using current technologies, such as mud pulse telemetry.

Most cables use various types of metals, such as copper or aluminum, to transmit electrical signals. These cables are generally fixed in length and are not suitable to be significantly stretched. In axially rigid tools, namely those tools that have a fixed length, integrating cable or other transmission media into the tool body may require little stretching or adjustment of the cable's length. However, in downhole tools such as drilling jars, where the length of the tool may change significantly, apparatus and methods are needed to integrate transmission cable into the tool body, while accommodating changes in the tool's length.

Another problem is the lack of space within the tool to integrate transmission cable. For example, in drilling jars, most of the internal space of the jar is dedicated to components, such as the hammer, anvil, hydraulic fluid, valves, and other moving parts. Thus, apparatus and methods are needed to integrate transmission cable into the tool, while avoiding interference with components inside the tool. Certain types of jars may accommodate the integration of transmission cable better than others depending on their internal structure and functions.

SUMMARY OF THE INVENTION

In view of the foregoing, it is a primary object of the present invention to provide apparatus and methods for integrating transmission cable into the body of selected downhole tools, such as drilling jars, having variable or changing lengths. It is a further object of the invention to integrate transmission cable into downhole tools, while avoiding interference with moving or other components within the tools. It is yet another object to accommodate changes in tension that may exist within transmission cable in downhole tools having variable length.

Consistent with the foregoing objects, and in accordance with the invention as embodied and broadly described herein, a wired downhole drilling tool is disclosed in one embodiment of the invention as including a housing and a mandrel insertable into the housing. A coiled cable is enclosed within the housing and has a first end connected to the housing and a second end connected to the mandrel. The coiled cable is configured to stretch and shorten in accordance with axial movement between the housing and the mandrel. A clamp is used to fix the coiled cable with respect to the housing, the mandrel, or both, to accommodate a change of tension in the coiled cable.

In selected embodiments, the coiled cable is comprised of a transmission cable enclosed within a conduit. In certain embodiments, the conduit may be constructed of a resilient or elastic material, such as stainless steel. This may enable the conduit to be shaped or molded into a spring-like coil that returns to its original dimensions after being stretched or compressed. In selected embodiments, the spring-like coil may be kept in compression within the housing such that the spring-like coil expands according to the available space within the tool.

In selected embodiments, the clamp may be configured to increase its grip on the coiled cable in response to an increase in tension in the coiled cable. This may decrease the chance of the conduit slipping with respect to the clamp. In certain embodiments, the clamp is configured to hold at least 10 pounds of tension in the coiled cable. In selected embodiments, the coiled cable may comprise a first straight portion, a coiled portion, and a second straight portion. The clamp may grip the coiled cable proximate the junction between the first straight portion and the coiled portion, the junction between the second straight portion and the coiled portion, or both. This allows the first straight portion, the second straight portion, or both, to be tensioned greater than the coiled portion. In selected embodiments, the first straight portion, the coiled portion, and the second straight portion are formed from a single continuous cable.

In another aspect of the invention, a method for wiring a downhole-drilling tool, wherein the downhole-drilling tool has a housing and a mandrel insertable and axially translatable with respect to the housing, includes connecting a first end of a coiled cable to the mandrel. The method further includes connecting a second end of the coiled cable to the housing, wherein the coiled cable stretches and shortens according to axial movement between the housing and the mandrel. The method further includes fixing the coiled cable with respect to at least one of the housing and the mandrel, to accommodate a change of tension in the coiled cable.

In selected embodiments, the coiled cable may comprise a transmission cable enclosed within a conduit. In certain embodiments, the conduit may be constructed of a resilient material. For example, constructing the conduit of a resilient material may enable the conduit to be formed into a spring-like coil. Such a spring-like coil, for example, may be in constant compression within the housing.

In certain embodiments, fixing may include increasing the grip on the coiled cable in response to an increase in tension in the coiled cable. In certain embodiments, fixing may include resisting at least 10 pounds of tension in the coiled cable. In selected embodiments, the coiled cable may comprise a first straight portion, a coiled portion, and a second straight portion. Fixing may further comprise fixing the coiled cable proximate the junction between the first straight portion and the coiled portion, the junction between the second straight portion and the coiled portion, or both. In this way, the first straight portion, the second straight portion, or both, may be tensioned differently than the coiled portion. In selected embodiments, the first straight portion, the coiled portion, and the second straight portion are formed from a single continuous cable. Fixing may include a step such as welding, gluing, clamping, or a combination thereof, of the coiled cable to the housing, the mandrel, or both, to absorb a change of tension in the cable.

In another aspect of the invention, a wired downhole-drilling tool includes a housing and a mandrel insertable into the housing. The mandrel is axially translatable but rotationally fixed with respect to the housing. A cable is coiled around the mandrel and enclosed by the housing. A clamp fixes the cable with respect to the housing, the mandrel, or both, to accommodate changes of tension in the cable.

BRIEF DESCRIPTION OF THE DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
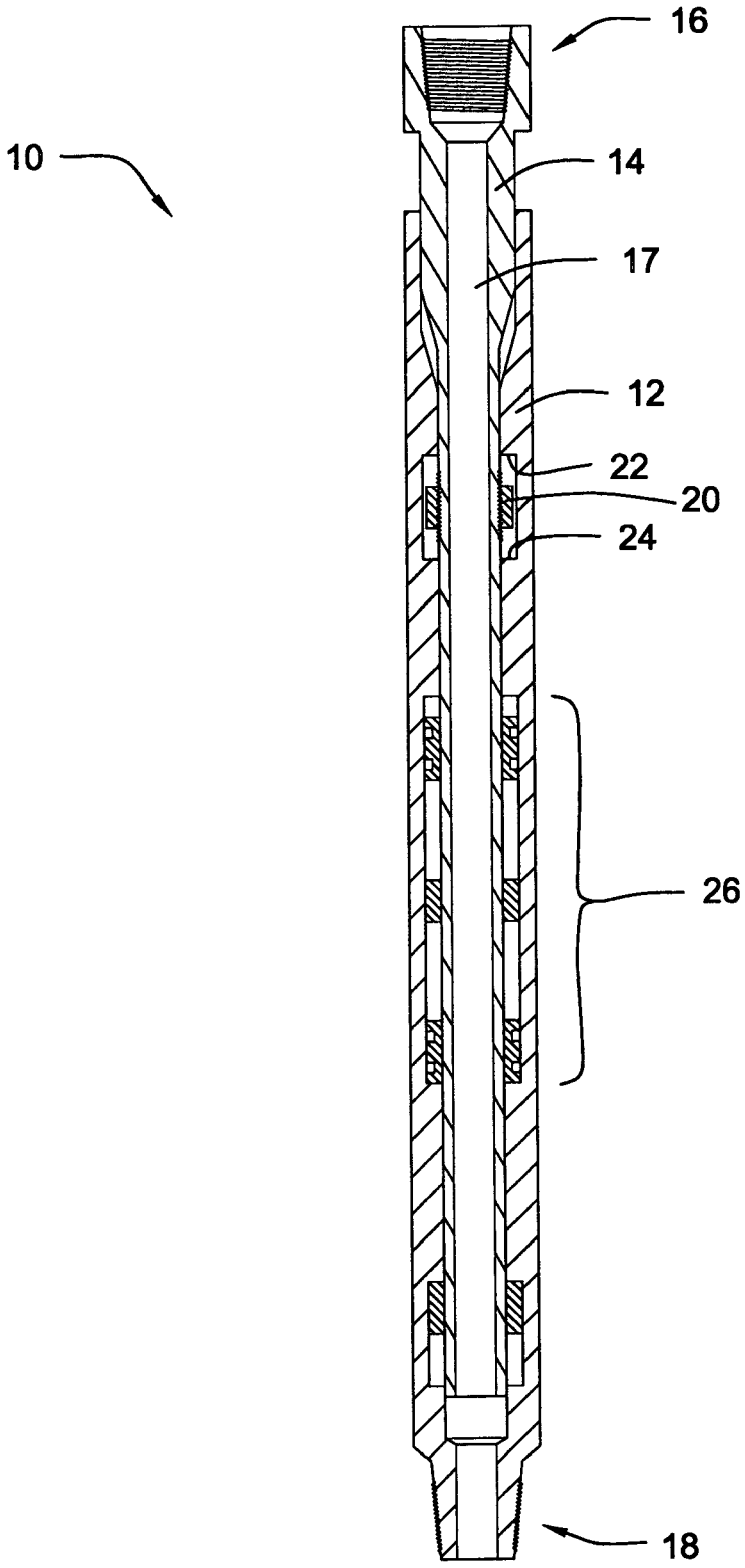
FIG. 1 is a cross-sectional view of one embodiment of a drilling jar for use with the present invention.

Referring to FIG. 1, a drilling jar 10 adaptable for use with the present invention is illustrated. The drilling jar 10 is illustrated very generally to illustrate various features, components, and functions that may be typical of a wide variety of drilling jars. More specific details of the drilling jar are not described in this specification and are unneeded to accurately describe apparatus and methods in accordance with the invention. For more specific details with respect to the internal functions of selected drilling jars, the reader is referred to issued patents such as U.S. Pat. No. 5,647,466 to Wenzel or U.S. Pat. No. 5,984,028 to Wilson.

The majority of drilling jars 10 include a housing 12 and a mandrel 14 inserted into the housing 12. The mandrel 14 is axially translatable with respect to the housing 12 to permit variation of the jar's length. That is, the mandrel 14 may slide into or out of the housing 12. However, the mandrel 14 is typically rotationally fixed with respect to the housing to allow a torque to be applied through the drilling jar 10 to other connected downhole tools. As is customary in most downhole drilling tools, the jar 10 includes a box end 16 and a pin end 18 to enable connection to other components or tools of a drill string.

As was previously described, the jar 10 provides its "jarring" effect by allowing rapid axial movement between the mandrel 14 and the housing 12. This axial movement is stopped when a hammer 20 rigidly connected to the mandrel 14 comes into contact with an anvil 22, 24 of the housing 12. The hammer 20 may contact a first anvil 22 to send a shock wave in a first direction up the drill string. Likewise, the hammer 20 may contact a second anvil 24 to send a shock wave in the opposite direction. The range of axial movement of the housing 12 with respect to the mandrel 14 is typically on the order of 24 inches or less.

Likewise, a drilling jar 10 may include a release mechanism 26. When it is desired to send a shock wave up or down a drill string, tension or compression is placed on the drill string, depending on the direction the shock wave is to be sent. The release mechanism 26 serves to resist axial translation of the housing 12 with respect to the mandrel 14 caused by this tension or compression, thereby allowing potential energy to be stored in the drill string. The release mechanism 26 may allow slight axial movement between the housing 12 and the mandrel 14. The release mechanism 26 reaches a threshold wherein resistance to the axial movement is released, thereby allowing the stored potential energy to cause rapid axial movement between the housing 12 and the mandrel 14. The hammer 20 then strikes one of the anvils 22, 24, causing the shock wave. The release mechanism may operate using hydraulics, springs, or other methods, as desired, to provide functionality to the jar 10.

Figure 2:
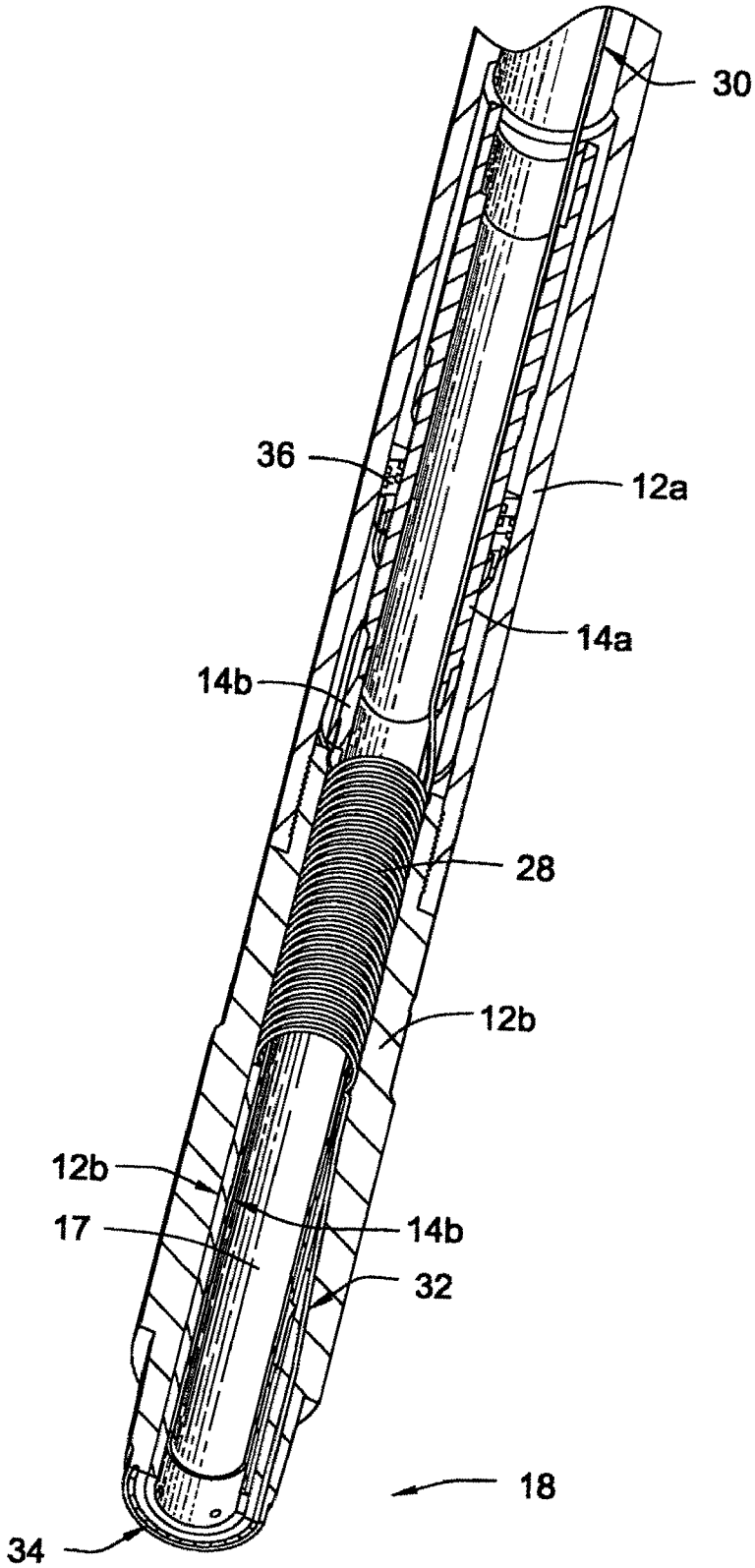
FIG. 2 is a perspective cross-sectional view of one embodiment of a cable routed through a jar.

Referring to FIG. 2, one embodiment of a pin end 18 of a selected drilling jar 10 is illustrated. Nevertheless, the technology described herein may be equally applicable to other types of drilling jars having diverse configurations. For example, as illustrated, an apparatus in accordance with the invention is installed near the pin end 18 of a drilling jar 10. However, in other types of drilling jars 10, it may be appropriate to install similar apparatus near the box end 16. This may depend on the design of the mandrel 14 and the housing 12 and the space available or constraints of each particular drilling jar 10.

The drilling jar 10 illustrated in FIG. 2 illustrates one type of drilling jar 10 that has been found suitable for use with apparatus and methods in accordance with the invention. The drilling jar 10 and corresponding components into which apparatus and methods in accordance the invention are integrated is the Dailey Hydraulic Drilling Jar manufactured by Weatherford Corporation. For further details regarding this drilling jar, the reader should refer to technical materials distributed by the manufacturer. Other types and configurations of drilling jars 10, produced by either the same or other manufacturers, may be adaptable for use with apparatus and methods in accordance with the invention. These other jars are, therefore, intended to be captured within the scope of this specification and accompanying claims.

As was previously discussed, transmission cable or other transmission media may be integrated directly into drill strings. This may allow data to be transmitted at high speed from downhole drilling components, such as those located proximate a bottom hole assembly, to the surface for analysis. Data may also be transmitted from the surface to downhole components.

Although most downhole tools have a fixed length, selected downhole tools, such as downhole drilling jars 10, may actually vary in length. This variable length creates several challenges when integrating transmission cable into the tool. Thus, what are needed are apparatus and methods for integrating transmission cable into these types of tools that can accommodate the variation in length. It is worthy to note that apparatus and methods in accordance with the invention may be applicable in downhole drilling tools of variable length other than downhole drilling jars 10. These other tools, whatever they might be, are also intended for capture within the scope of the specification and accompanying claims.

As previously described, a downhole-drilling jar 10 may include a mandrel 14 that may slide in an axial direction with respect to a housing 12. In selected embodiments, the mandrel 14 may comprise multiple components 14*a*, 14*b* connected together. Likewise, the housing 12 may also include multiple components 12*a*, 12*b* connected together. That is, the mandrel components 14*a*, 14*b* that are connected together may function as a single rigid component 14 that may slide with respect to housing components 12*a*, 12*b* that may also function as a single rigid component 12. The components 12*a*, 12*b*, 14*a*, 14*b* may take on various forms, as needed, in accordance with a particular design or configuration of a drilling jar 10.

Various seals 36, pistons 36, or other components 36 may be present between the mandrel 14*a*, 14*b*, and the housing 12*a*, 12*b* to provide bearing surfaces on which the mandrel 14 or housing 12 slides, or to retain fluids, such as hydraulic fluid, or gasses within various internal chambers 37*a*, 37*b* between the housing 12 and the mandrel 14.

In accordance with the invention, a coiled transmission line 28 may be inserted within the housing 12 and coiled around the mandrel 14. The coiled transmission line 28 is used to accommodate axial movements between the mandrel 14 and the housing 12. When movement between the mandrel 14 and the housing 12 occurs, the coil 28 may stretch and compress as a spring, thereby increasing or decreasing in length. The coil may include a first end 30 that may interface or be integrated into the mandrel 14 and a second end 32 that is integrated into housing 12. In selected embodiments, the coil 28 and corresponding first and second ends 30, 32 are formed from a continuous section of transmission cable or other transmission media.

Figure 3:
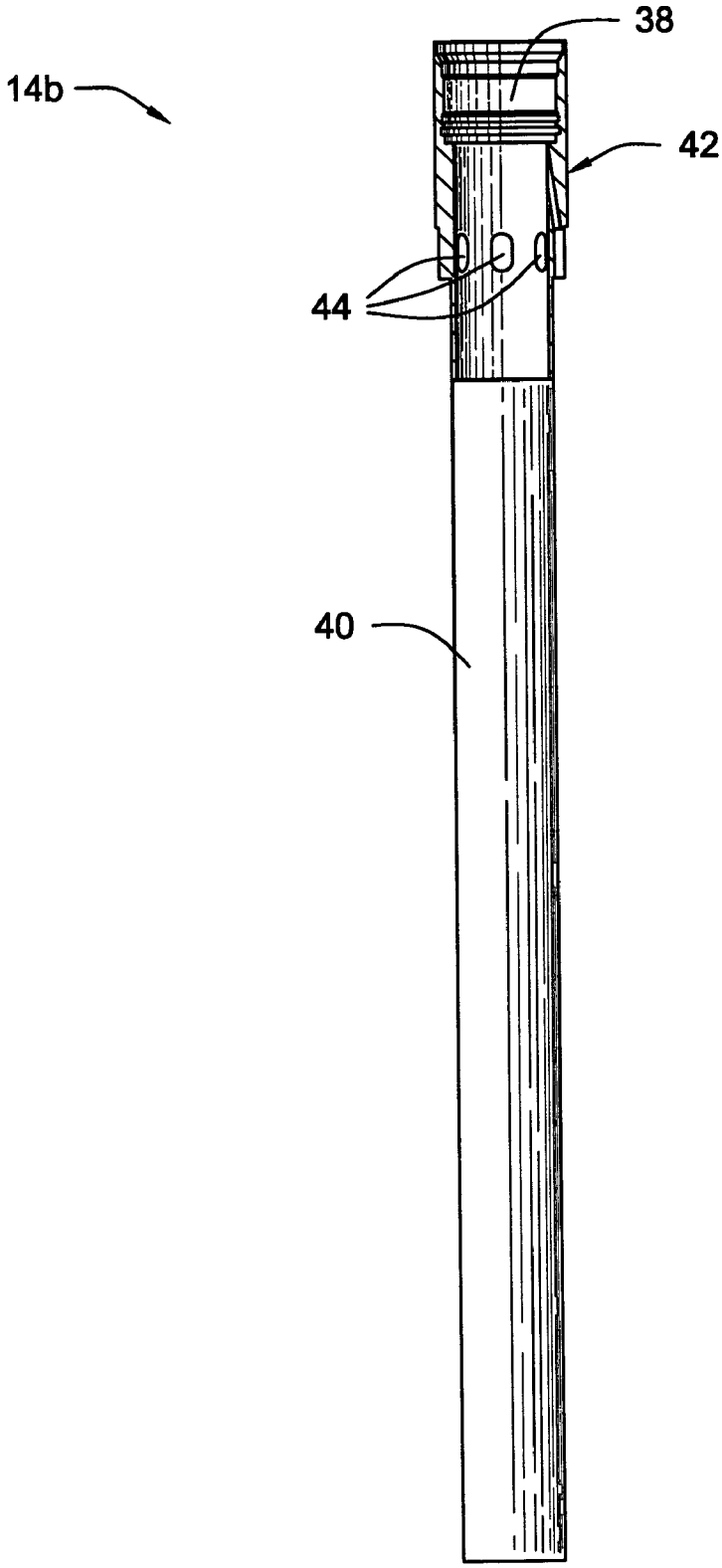
FIG. 3 is a cross-sectional view illustrating one embodiment of one component of the jar mandrel.

Referring to FIG. 3, one component 14*b* of the mandrel 14 may appear as illustrated. As was previously mentioned, the component 14*b* is specific to the drilling jar illustrated and is not necessarily representative of all or even the majority of drilling jars 10 available. Thus, apparatus and methods in accordance with the invention should not be limited to this particular configuration, the same being used only as an example.

The mandrel component 14*b* may include an outer cylindrical surface 40 that may or may not contact the inner surface of the housing 12. The mandrel component 14*b* may also include an opening 38 or junction point 38 where the mandrel component 14*b* may connect, using threads or other means, to other components or sections of the mandrel 14. An anti-rotation mechanism 42, which may consist of a series of flat faces, may be integrated into the mandrel 14 to prevent the mandrel 14 from rotating with respect to the housing 12. The mandrel component 14*b* may also be formed to include one or several apertures 44 that may provide various functions. For example, the apertures may perform tasks such as permitting the flow of fluids or gases through the mandrel component, releasing pressure buildup in chambers of the jar 10, permit the dissipation of heat, or the like.

Figure 4:
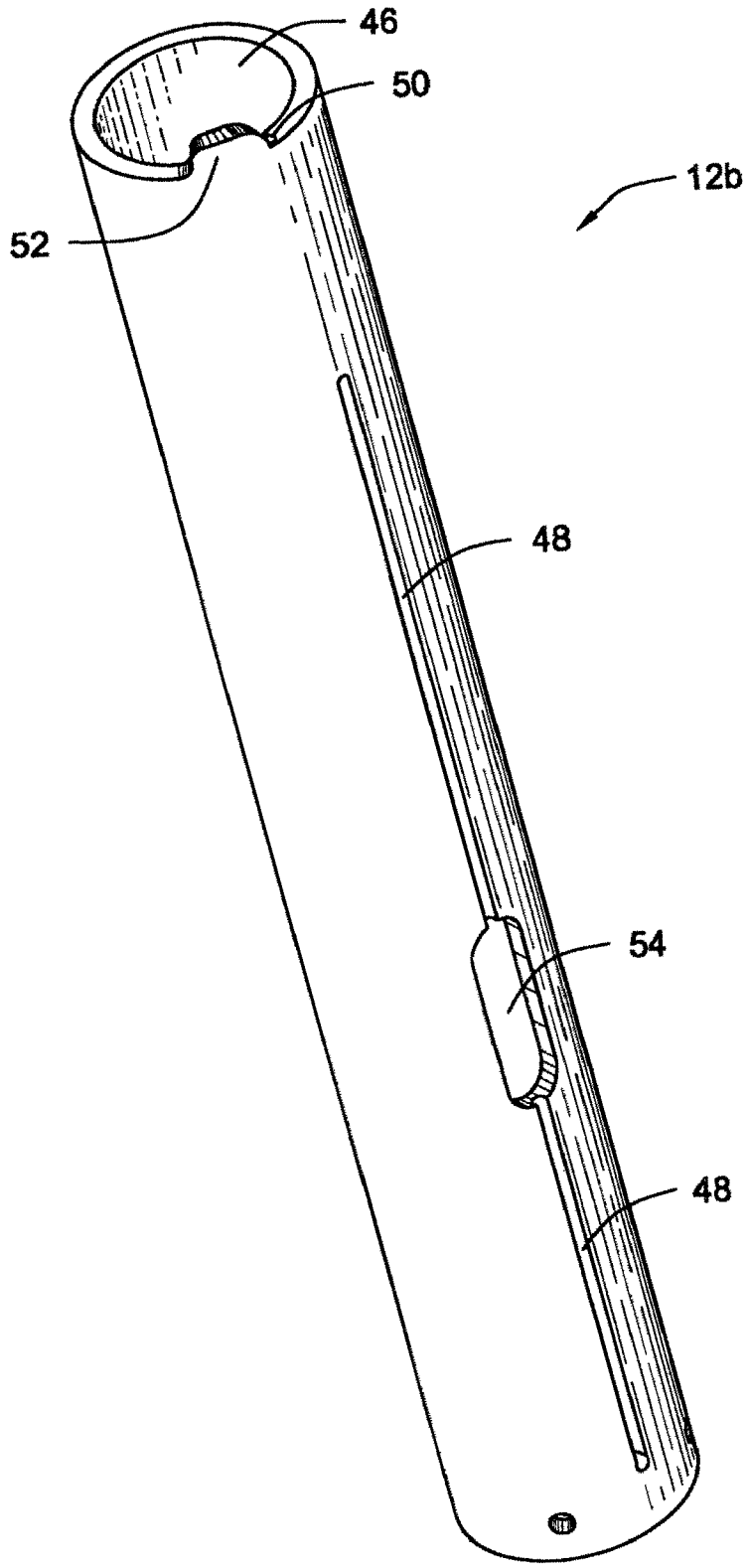
FIG. 4 is a perspective view illustrating one embodiment of a component of the jar housing.

Referring to FIG. 4, a corresponding housing component 12*b*, into which the mandrel component 14*b* slides, may appear as illustrated. The housing component 12*b* includes an interior surface 46 that slides with respect to and in close proximity to the corresponding outer surface 40 of the mandrel component 14*b*. A channel 48 may be formed or milled into the housing component 12*b* to accommodate a transmission line. The channel 48 may be open to permit the transmission line to transition from the housing component 12*b* to another component of the housing 12.

An aperture 50 is provided in the housing component 12*b* to allow the exit of the transmission line from the housing component 12*b*. A contoured support 52 may be provided to support and relieve stress from bends present in the transmission line. The housing component may also include one or several apertures 54, providing any of various functions such as those mentioned with respect to apertures 44 described in FIG. 3.

Figure 5:
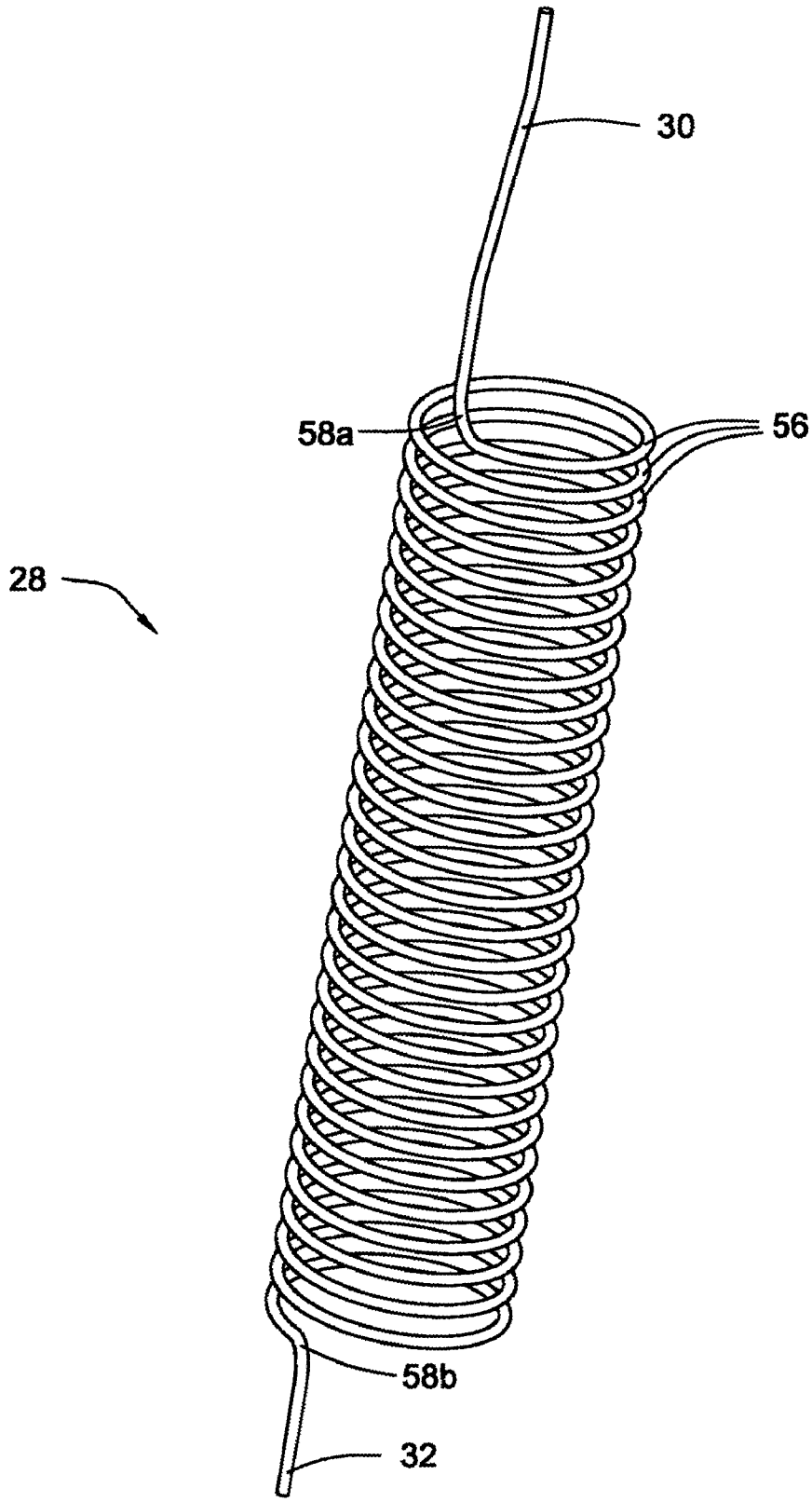
FIG. 5 is a perspective view illustrating one embodiment of a coiled cable in accordance with the invention.

Referring to FIG. 5, a coiled transmission line 28 is illustrated. The coiled transmission line 28 may include multiple coils 56 to expand and contract in a spring-like manner to accommodate axial variations in the jar's length. The coils 56 may transition to substantially straight sections 30, 32 by way of bends 58*a*, 58*b* in the coiled line 28. In selected embodiments, the transmission line 28 may include an outer conduit enclosing one or several transmission cables. For example, the outer conduit may be constructed of a material, such as stainless steel, to resist corrosion as well as to provide the spring-like characteristics of the coiled transmission line 28. The stainless steel is sufficiently resilient to return to its original shape after being stretched or compressed.

It has also been found advantageous to form the transmission line 28 from a single continuous section of conduit, although this is not mandatory. Prior to this application, the forming of a stainless steel conduit into multiple spring-like coils was not known. Continuity of the transmission line 28 prevents various problems that may arise from having multiple connections within the jar and also facilitates higher tensioning of the straight sections 30, 32 of the transmission line 28 compared to the coils 56.

Figure 6:
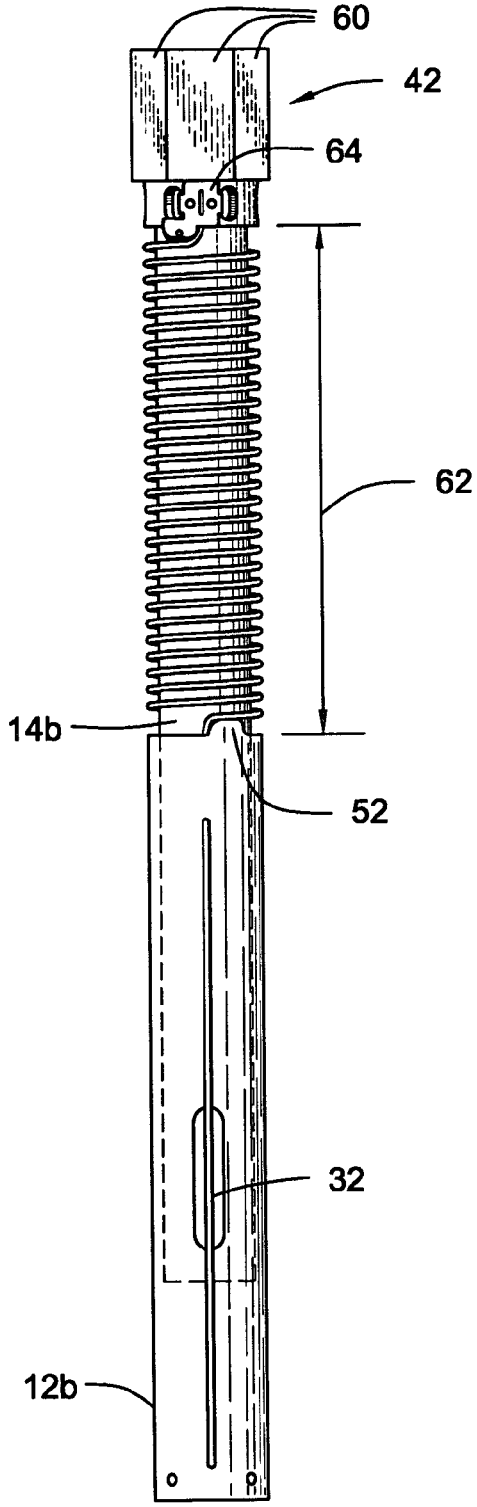
FIG. 6 is a perspective view illustrating one embodiment of the relationship between the coiled cable and components of the jar housing and jar mandrel in an expanded or partially expanded state.

Referring to FIG. 6, the coiled transmission line 28 is integrated with the mandrel component 14*b* and the housing component 12*b*. As illustrated, the housing and mandrel components 12*b*, 14*b* are in an extended state 62. Likewise, the coiled transmission line 28 is also in an extended or expanded state 62. In selected embodiments, the coiled transmission line 28 may be in constant compression. That is, the coiled transmission line 28 may be "sprung" such that it is always in compression, whether the housing and mandrel components 12*b*, 14*b* are in an extended or non-extended state. This may keep the coiled transmission line 28 stable and prevent rattling or unnecessary movements of the transmission line 28 with respect to the housing and mandrel components 12*b*, 14*b*.

As illustrated, the contoured support 52 conforms to the shape or bend of the transmission line 28 as it transitions from the coiled portion to the straighter section 32. Likewise, a clamp 64 may also be used where the coiled transmission line 28 transitions to a straighter section 30.

In certain embodiments, such as may be the case with the section 30 of the transmission line, the section may be routed a significant distance through the central bore 17 of the jar 10 (not shown). In order to keep the section 30 tautly strung through the central bore 17 and to prevent the movement of the section 30 that may occur in the midst of drilling mud, pressure, and other substances and activity within the central bore 17 of the jar 10, the section 30 may be tensioned significantly. Thus, apparatus and methods are needed to securely hold the ends of the section 30 to maintain a desired tension. The clamp 64 may serve to securely hold the transmission line and enable a significant change in tension between the coiled section 28 and the straighter section 30.

Likewise, the section 32 may also be tensioned higher than that of the coiled portion 28. However, since this section 32 may be significantly shorter than the section 30, the tension may not be as high and a clamp may not be needed. The bend 58*b* in the conduit may be sufficient to withstand the change in tension. Nevertheless, in selected embodiments, it may be desirable to provide a clamp at or near the bend 58*b*.

Figure 7:
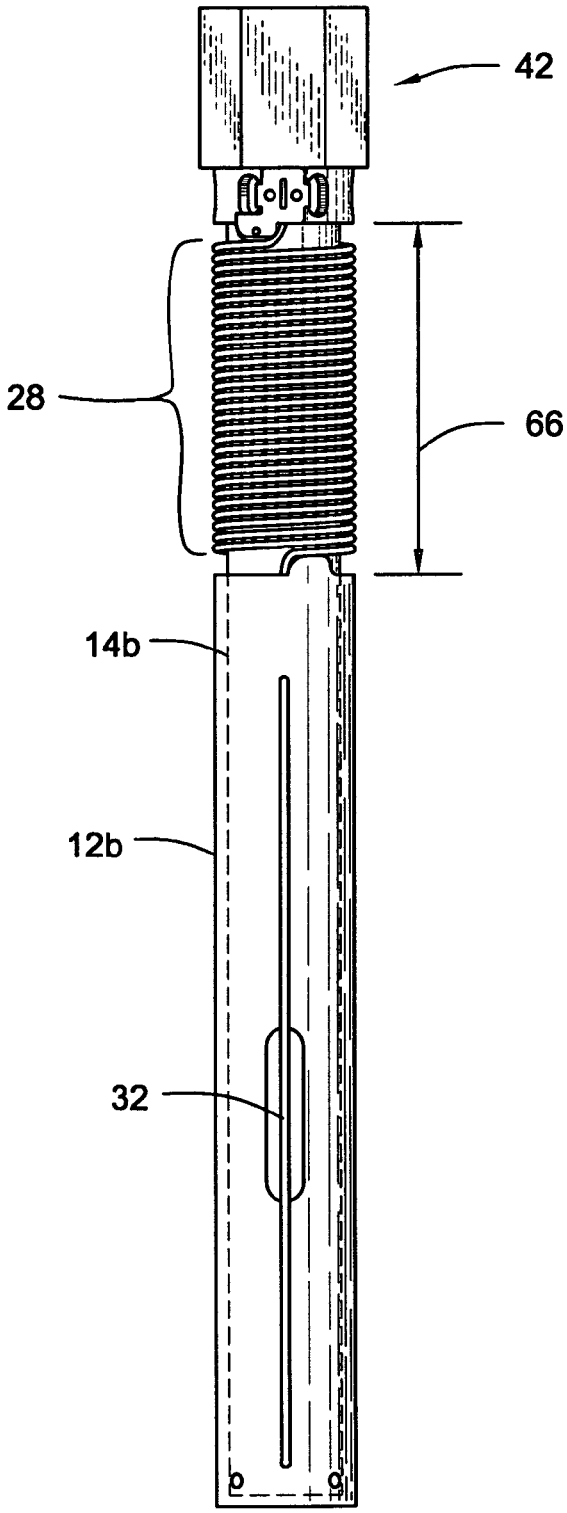
FIG. 7 is a perspective view illustrating one embodiment of the relationship between the coiled cable and components of the jar housing and jar mandrel in a compressed or partially compressed state.

Referring to FIG. 7, as illustrated, the housing and mandrel components 12*b*, 14*b* are in a compressed or non-extended state 62. Likewise, the coiled transmission line 28 is also in a compressed state 66. The compressed state illustrated in FIG. 7 shows the approximate relationship of components when the hammer 20 strikes the lower anvil 24, while the state illustrated in FIG. 6 shows a relationship of components when the hammer 20 strikes the upper anvil 22.

Figure 8:
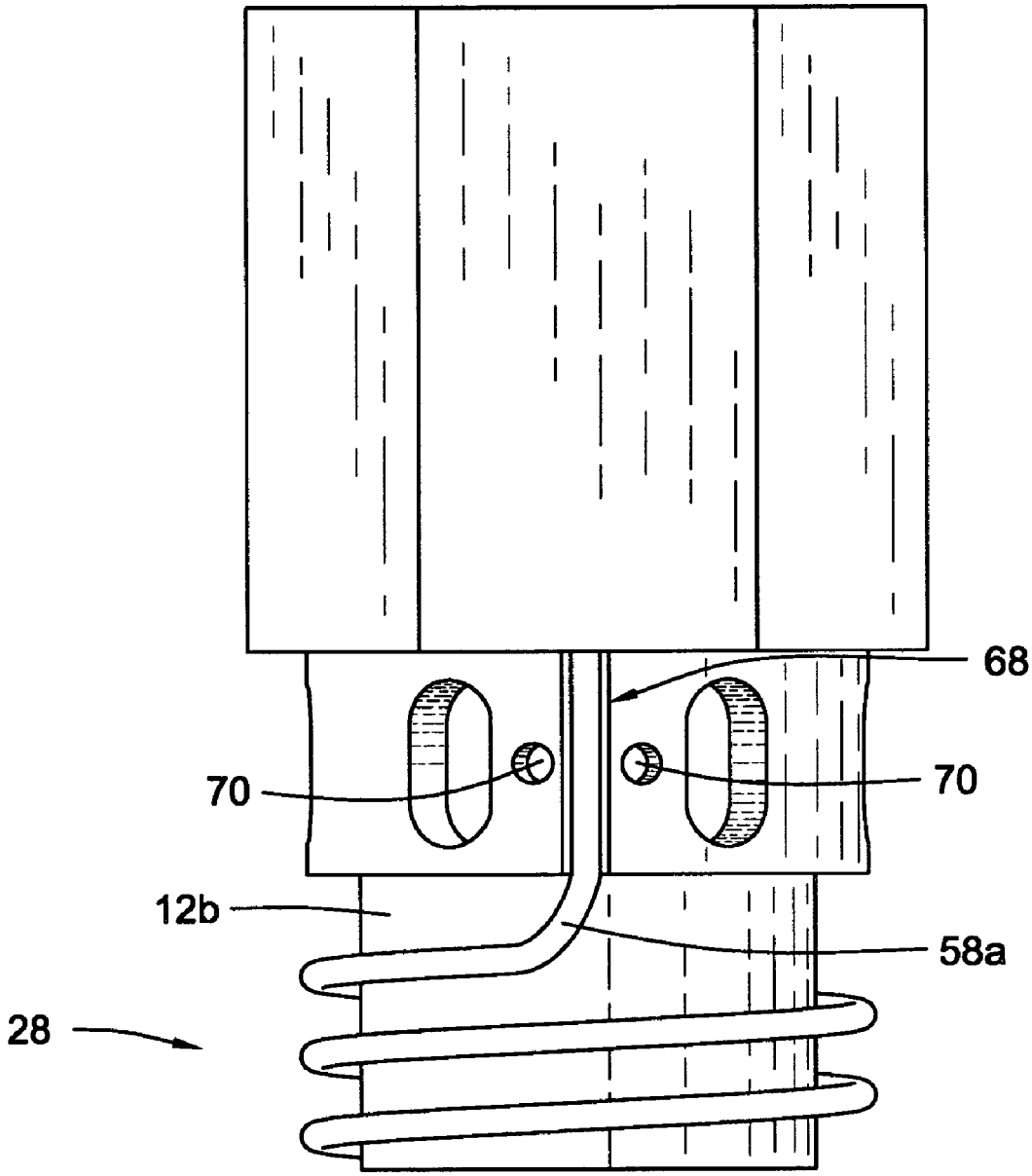
FIG. 8 is a front view illustrating one embodiment of a coiled cable passing though a recess in a component of the mandrel.

Referring to FIG. 8, a channel 68 or recess 68 may be formed in the mandrel component 14*b* to route the coiled transmission line 28 to the central bore 17 of the jar 10. In selected embodiments, one or several threaded apertures 70 may be provided to securely mount the clamp 64 (not shown). The clamp 64 may be used to securely fix the transmission line 28 and also provide support to the bend 58*a*.

Figure 9:
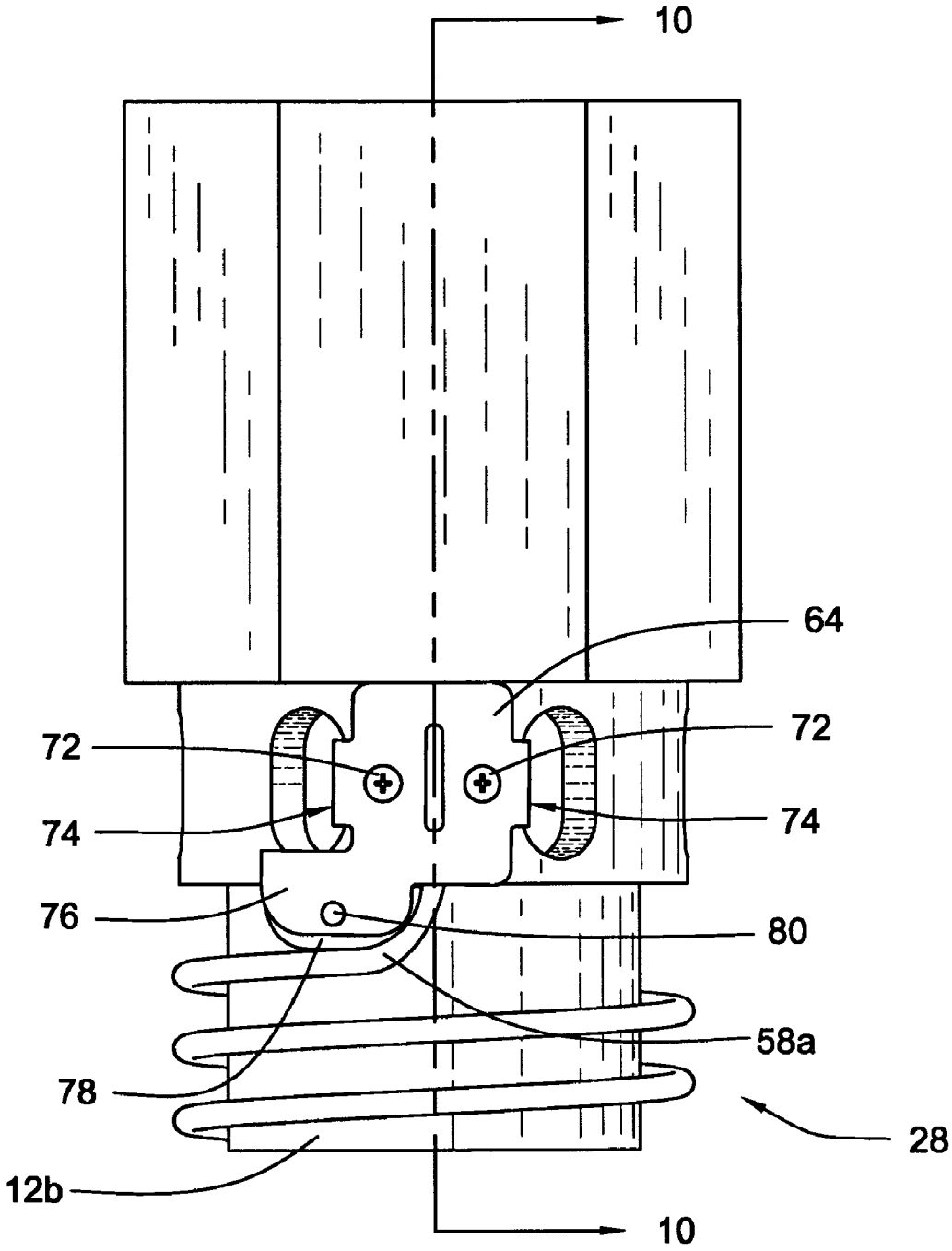
FIG. 9 is a front view illustrating one embodiment of a coiled cable retained by a clamp in accordance with the invention.

Referring to FIG. 9, in selected embodiments, the clamp 64 may be attached to the mandrel component 14*b* to secure the transmission line 28. In this embodiment, the clamp 64 has several tabs 74 that engage apertures 44 to provide additional strength to the clamp 64, although this is not mandatory. One or several fasteners 74, such as screws 74, may be used to secure the clamp 64 to the mandrel component 14*b*. The clamp 64 may optionally include a support mount 76 to provide structural support 76 to the bend 58*a* in the transmission line 28. The structural support 76 may include an elastomeric, plastic, metal, or other contoured support 78 to support the bend 58*a*, and may be connected thereto with a fastener 80.

Figure 10:
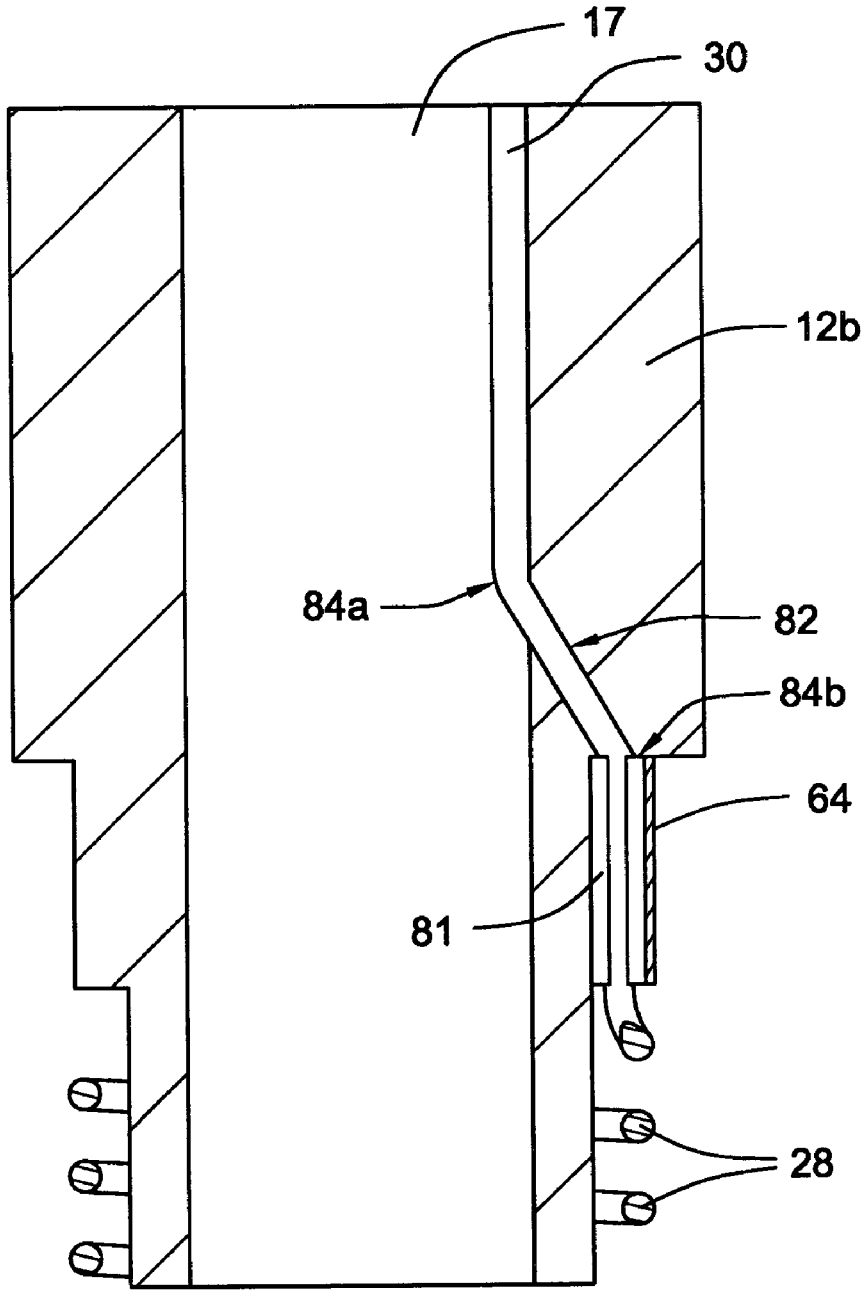
FIG. 10 is a cross-sectional side view of the illustration of FIG. 9 illustrating one embodiment of a coiled cable passing through a channel in the mandrel into the central bore of the mandrel.
Figure 11:
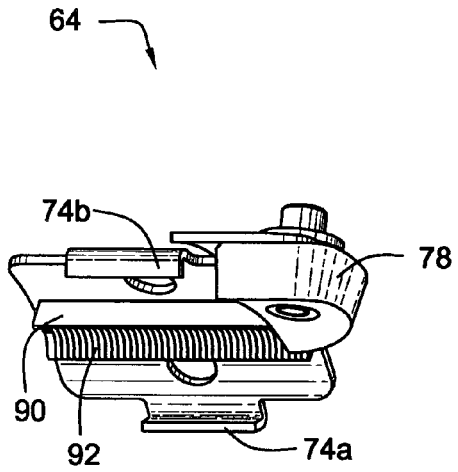
FIGS. 11–14 are several perspective views of one embodiment of a clamp in accordance with the invention.
Figure 12:
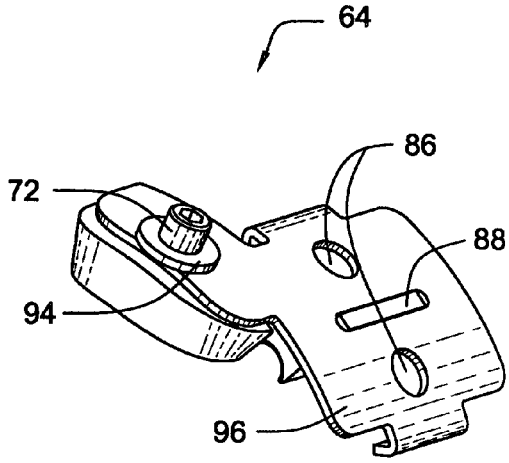
Figure 13:
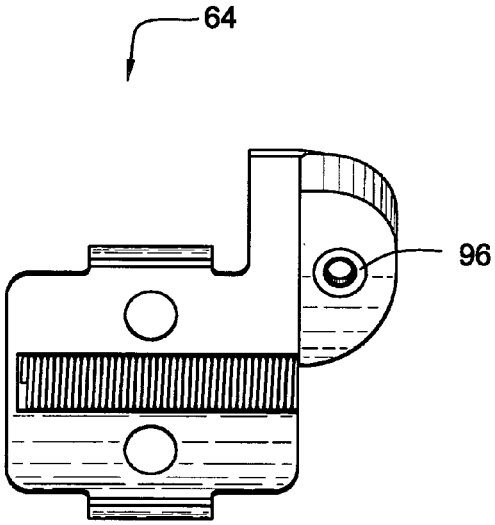
Figure 14:
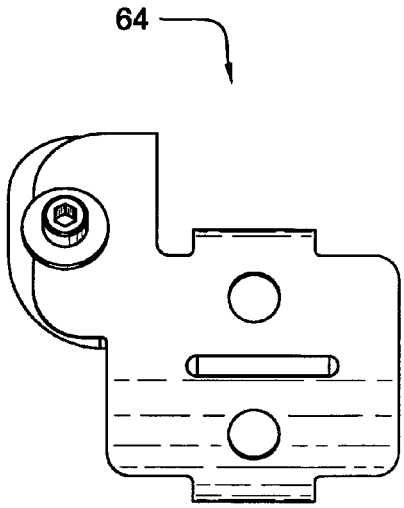

Referring to FIG. 10, a cross-sectional view of the apparatus of FIG. 9 is illustrated. The coiled transmission line 28 may be routed through a channel 82 in the wall of the mandrel component 14*b*. In selected embodiments, several bends 84*a*, 84*b* may be formed in the transmission line such that it may extend through the wall and be routed through the central bore 17 of the jar 10.

Also illustrated is the clamp 64, providing a clamping force on the transmission line 28, and an optional bottom grip 81 configured to assist the clamp 64 in gripping the transmission line 28. The clamp 64 and corresponding bottom grip 81 may be configured to increase their grip on the transmission line 28 in response to increased tension in the line 28. For example, an increase in tension in the line 30 may urge the bottom grip 81 in an upward direction. Since the bottom grip 81 is rigid and will resist going around the bend 84, the net effect will be to squeeze the line 28 tighter, thereby providing a better grip.

Referring to FIGS. 11 through 14, various perspective views of a clamp 64 in accordance with the invention are illustrated. One or several apertures 86 may be included in the body 96 of the clamp 64 to provide a means for attaching the clamp 64 to the mandrel component 14*b*. The clamp body 96 may also be rounded to better conform to the cylindrical contour of the mandrel component 14*b*.

In order to grip the transmission line 28, a grip mechanism 90 may be integrated or attached to the clamp 64. The grip mechanism may include teeth 92 or other surface textures to grip or engage the transmission line 28. The grip mechanism 90 may also have a rounded contour 92 to conform to the transmission line 28. In selected embodiments, an aperture 88 may be included in the clamp body 96 to align, connect, or both, the grip mechanism 90 to the clamp 64.

As was previously mentioned, the clamp body 96 may include one or several tabs 74*a*, 74*b* to engage apertures 44 in the mandrel component 14*b*. Likewise, a support 78 may also be integrated into or attached to the clamp body 96. The support 78 may be constructed of any suitable material, including rubber, plastic, metal, and the like, and may be attached to the clamp body 96 with an adhesive or a fastener 72, such as a washer 94 and screw 72.

Figure 15:
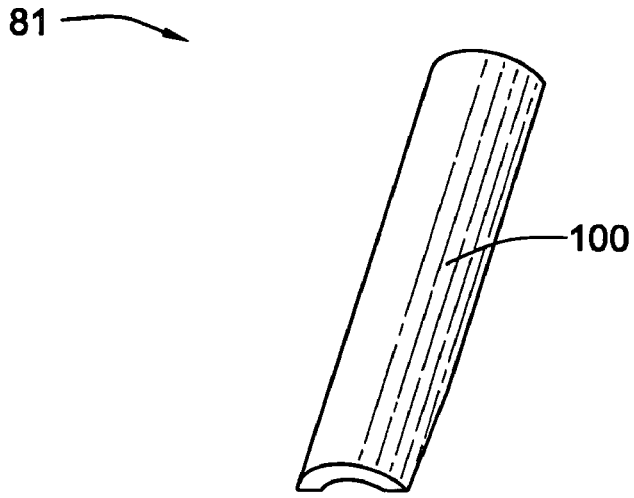
FIGS. 15–16 are several perspective views of one embodiment of a complementary clamping mechanism that may be included with the clamp illustrated in FIGS. 11–14.
Figure 16:
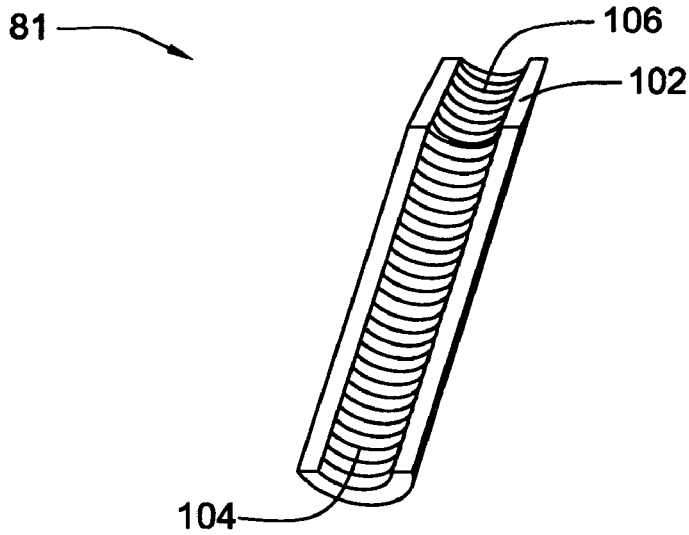

Referring to FIGS. 15 and 16, in one embodiment, a bottom grip 81, as described in FIG. 10, may include a contoured surface 104 having teeth or other gripping texture to grip the transmission line 28. The bottom grip 81 may also include an angled portion 102 having teeth 106 or other texture 106 to grip the transmission line 28 at or near the bend 84*b* (See FIG. 10). Likewise, the bottom grip 81 may have a bottom surface 100 that slides with respect to the bottom of the channel 68 or recess 68. Thus, when the transmission line 30 is pulled tighter, the bottom grip 81 may move slightly toward the bend 84*b* with the transmission line 30. This may cause the teeth 106 to dig into or grip the transmission line 30 in proportion to the increased tension.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. A wired downhole drilling tool comprising: a housing; a mandrel insertable into the housing, wherein the mandrel is axially translatable with respect to the housing; a coiled cable, enclosed by the housing, having a first end connected to the housing and a second end connected to the mandrel, the coiled cable configured to elongate and shorten in accordance with axial movement between the housing and the mandrel; a clamp effectively fixing the coiled cable with respect to at least one of the housing and the mandrel, to accommodate a change of tension in the coiled cable wherein the clamp increases its grip on the coiled cable in response to an increase in tension therein.

2. The wired downhole drilling tool of claim 1, wherein the coiled cable comprises a transmission cable enclosed within a conduit.

3. The wired downhole drilling tool of claim 2, wherein the conduit is constructed of a resilient material.

4. The wired downhole drilling tool of claim 3, wherein at least a portion of the conduit is formed into a spring-like coil.

5. The wired downhole drilling tool of claim 4, wherein the spring-like coil is in compression within the housing.

6. The wired downhole drilling tool of claim 1, wherein the clamp can resist at least 10 pounds of tension in the coiled cable.

7. The wired downhole drilling tool of claim 1, wherein the coiled cable comprises a first substantially straight portion, a coiled portion, and a second substantially straight portion.

8. The wired downhole drilling tool of claim 7, wherein the clamp contacts the coiled cable proximate at least one of the junction between the first straight portion and the coiled portion, and the junction between the second straight portion and the coiled portion.

9. The wired downhole drilling tool of claim 7, wherein at least one of the first straight portion and the second straight portion is tensioned greater than the coiled portion.

10. The wired downhole drilling tool of claim 7, wherein the first straight portion, the coiled portion, and the second straight portion are formed from a single continuous cable.

11. A method for wiring a downhole drilling tool having a housing and a mandrel insertable into the housing, wherein the mandrel is axially translatable with respect to the housing, the method comprising: connecting a first end of a coiled cable to the mandrel; connecting a second end of the coiled cable to the housing, the coiled cable configured to elongate and shorten in accordance with axial movement between the housing and the mandrel; fixing the coiled cable with respect to at least one of the housing and the mandrel, to accommodate a change of tension in the coiled cable such that the grip increases on the coiled cable in response to an increase in tension on the coiled cable.

12. The method of claim 11, wherein the coiled cable comprises a transmission cable enclosed within a conduit.

13. The method of claim 12, wherein the conduit is constructed of a resilient material.

14. The method of claim 13, wherein at least a portion of the conduit is formed into a spring-like coil.

15. The method of claim 14, wherein the spring-like coil is in compression within the housing.

16. The method of claim 11, wherein fixing further comprises resisting at least 10 pounds of tension in the coiled cable.

17. The method of claim 11, wherein the coiled cable comprises a first substantially straight portion, a coiled portion, and a second substantially straight portion.

18. The method of claim 17, wherein fixing further comprises fixing the coiled cable proximate at least one of the junction between the first straight portion and the coiled portion, and the junction between the second straight portion and the coiled portion.

19. The method of claim 17, further comprising tensioning at least one of the first straight portion and the second straight portion greater than the coiled portion.

20. The method of claim 17, further comprising forming the first straight portion, the coiled portion, and the second straight portion from a single continuous cable.

21. The method of claim 11, wherein fixing further comprises at least one of welding and gluing the coiled cable with respect to at least one of the housing and the mandrel, to absorb a change of tension in the cable.

22. A wired downhole drilling tool comprising: a housing; a mandrel insertable into the housing, wherein the mandrel is axially translatable but rotationally fixed with respect to the housing; a cable coiled around the mandrel end enclosed by the housing; a clamp effectively fixing the cable with respect to at least one of the housing and the mandrel, to accommodate a change of tension in the cable wherein the clamp increases its grip on the coiled cable in response to an increase in tension therein.

23. The wired downhole drilling tool of claim 22, wherein the mandrel comprises at least one tab to engage an aperture formed in the mandrel.

24. The wired downhole drilling tool of claim 22, wherein the cable is routed through a channel in a wall of the mandrel.

* * * * *